US006830539B2

(12) United States Patent
Chuang

(10) Patent No.: US 6,830,539 B2
(45) Date of Patent: Dec. 14, 2004

(54) STEPPING EXERCISER HAVING INCREASED LATERAL MOVEMENT

(76) Inventor: Jin Chen Chuang, No. 17, Lane 301, Nan Yang Road, Fong Yuan, Taichung Hsien (TW), 420

( * ) Notice: Subject to any disclaimer, the term of this patent is extended or adjusted under 35 U.S.C. 154(b) by 0 days.

(21) Appl. No.: 10/144,115

(22) Filed: May 14, 2002

(65) Prior Publication Data

US 2003/0216223 A1 Nov. 20, 2003

(51) Int. Cl.[7] ..... A63B 22/04
(52) U.S. Cl. ..... 482/53; 482/52; 482/80; 482/112
(58) Field of Search ..... 482/51–53, 79, 482/80, 111, 112, 146, 147

(56) References Cited

U.S. PATENT DOCUMENTS 5,267,923 A * 12/1993 Piaget et al. ..... 482/53
5,304,106 A * 4/1994 Gresko ..... 482/53
5,346,444 A * 9/1994 Hsieh ..... 482/53
5,403,254 A * 4/1995 Lundin et al. ..... 482/52
5,505,679 A * 4/1996 McBride et al. ..... 482/53
5,527,250 A * 6/1996 Chen ..... 482/96
5,924,961 A * 7/1999 Kuo et al. ..... 482/52
6,022,296 A * 2/2000 Yu ..... 482/52
6,066,076 A * 5/2000 Wang et al. ..... 482/52
6,102,833 A * 8/2000 Chen ..... 482/53
6,106,439 A * 8/2000 Boland ..... 482/51
6,206,806 B1 * 3/2001 Chu ..... 482/53
6,315,697 B1 * 11/2001 Chen ..... 482/53
6,544,146 B1 * 4/2003 Stearns et al. ..... 482/52
6,582,344 B2 * 6/2003 Tang ..... 482/53

* cited by examiner

*Primary Examiner*—Tam Nguyen
(74) *Attorney, Agent, or Firm*—Charles E. Baxley

(57) ABSTRACT

A stepping exerciser includes a pair of foot pedals each having a bent segment disposed on one end and bent relative to the foot pedals and pivotally secured to the base with a pivot shaft, for allowing the foot pedals to be moved up and down relative to the base. The foot pedals each includes a longitudinal axis offset from the pivot shaft, or an included angle is formed between the foot pedals and the bent segments, for increasing the lateral movement of the foot pedals when the foot pedals are moved up and down relative to the base.

5 Claims, 3 Drawing Sheets

STEPPING EXERCISER HAVING INCREASED LATERAL MOVEMENT

BACKGROUND OF THE INVENTION

1. Field of the Invention

The present invention relates to a stepping exerciser, and more particularly to a stepping exerciser having an increased lateral movement.

2. Description of the Prior Art

Typical stepping exercisers are shown in FIG. 5 and comprise a base 10, and a pair of foot pedals 12 having a front end pivotally secured to the base 10 with a pivot shaft 11, for allowing the foot pedals 12 to be moved up and down relative to the base 10. One or more resilient band or the other hydraulic or pneumatic cylinders 16 may further be provided and attached to the foot pedals 12 for applying a resistive force against the foot pedals 12. However, when the foot pedals 12 are rotated relative to the base 10 about the pivot shaft 11, the lateral movement "d" of the foot pedals is relatively small, such that the users are almost moved up and down relative to the base 10 only, and may not move forward and upward and downward and rearward, and such that the stepping exercisers may not be used for simulating the actual ladder climbing action or the real stepping exercises.

The present invention has arisen to mitigate and/or obviate the afore-described disadvantages of the conventional stepping exercisers.

SUMMARY OF THE INVENTION

The primary objective of the present invention is to provide a stepping exerciser including an increased lateral movement.

In accordance with one aspect of the invention, there is provided a stepping exerciser comprising a base including a first end having a pivot shaft provided therein, a pair of foot pedals including a first end having a bent segment provided thereon and bent and inclined relative to the foot pedals respectively, the bent segments each including a first end located close to the foot pedals respectively, and each including a second end pivotally secured to the base with the pivot shaft, for allowing the foot pedals to be moved up and down relative to the base. The foot pedals each includes a longitudinal axis offset from the pivot shaft, for increasing a lateral movement of the foot pedals when the foot pedals are moved up and down relative to the base.

A resistive device may further be provided for applying a resistive force against the foot pedals.

The bent segments each includes a longitudinal axis, the longitudinal axes of the foot pedals and the bent segments respectively include an included angle formed therebetween.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
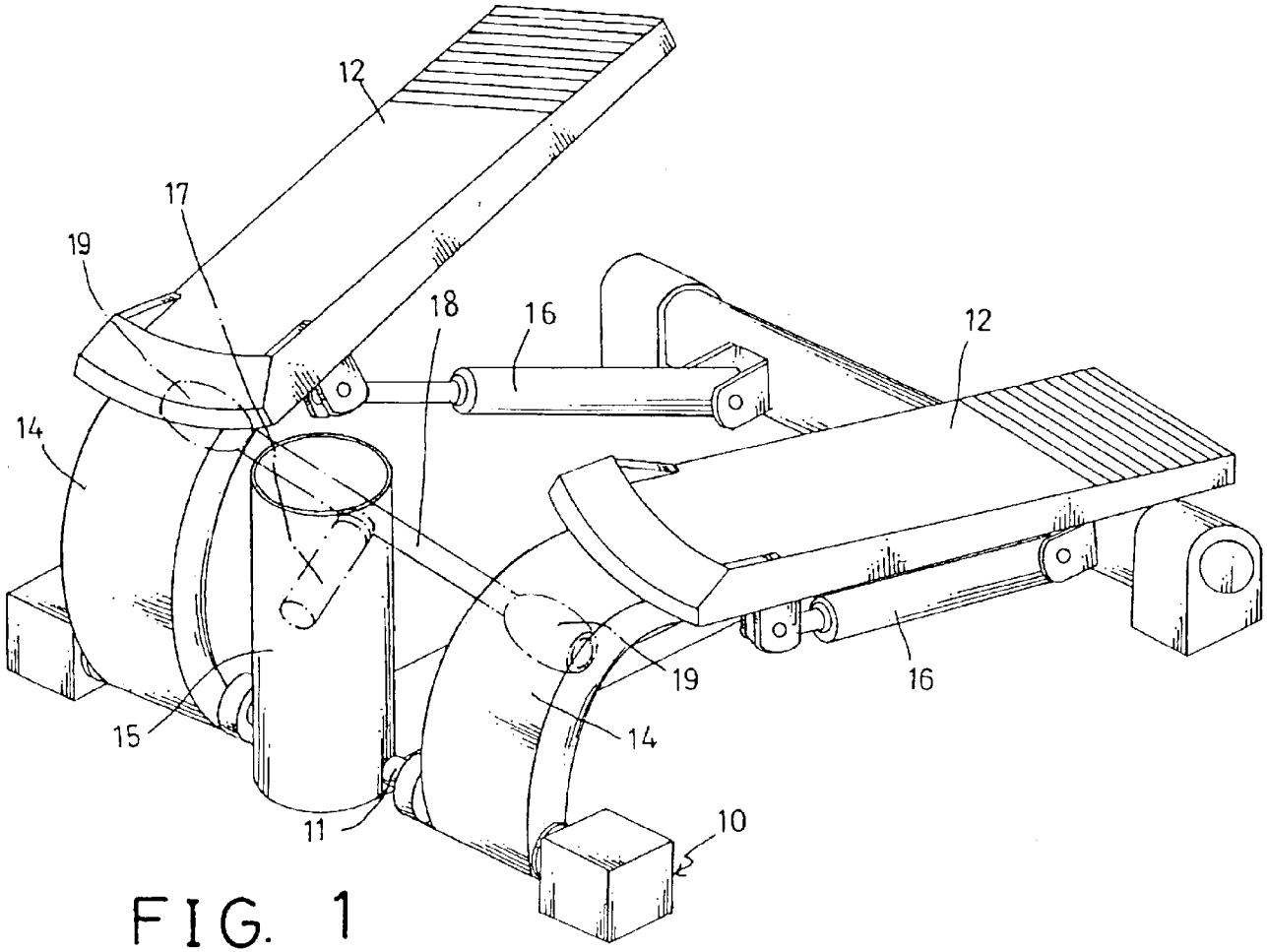
FIG. 1 is a perspective view of a stepping exerciser in accordance with the present invention.
Figure 2:
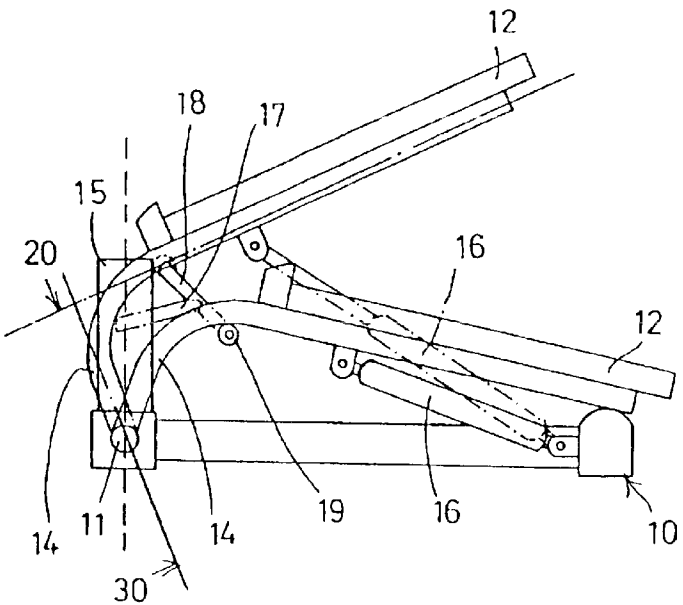
FIG. 2 is a side view of the stepping exerciser.

Referring to the drawings, and initially to FIGS. 1 and 2, a stepping exerciser in accordance with the present invention comprises a base 10 including a front portion having a shaft 11 provided therein, such as laterally provided therein. A pair of foot pedals 12 include a front portion pivotally or rotatably secured to the base 10 with the pivot shaft 11, for allowing the foot pedals 12 to be moved up and down relative to the base 10. One or more resilient belts or actuators 16 may further be provided and coupled to either or both of the foot pedals 12, for applying a resistive force against the foot pedals 12.

The foot pedals 12 each includes a bent segment 14 bent or inclined relative to the foot pedals 12 respectively, and provided on the front portion thereof. The bent segment 14 includes a first end formed integral to or secured to the foot pedal 12 or located close to the foot pedal 12, and a second end pivotally secured to the pivot shaft 11, such that the plane or the longitudinal axis 20 of the foot pedal 12 is offset from the pivot shaft 11, best shown in FIG. 2. The bent segment 14 also includes a plane or a longitudinal axis 30, and an included angle "a" will be formed between the longitudinal axes 20, 30 of the foot pedal 12 and the bent segment 14.

Figure 3:
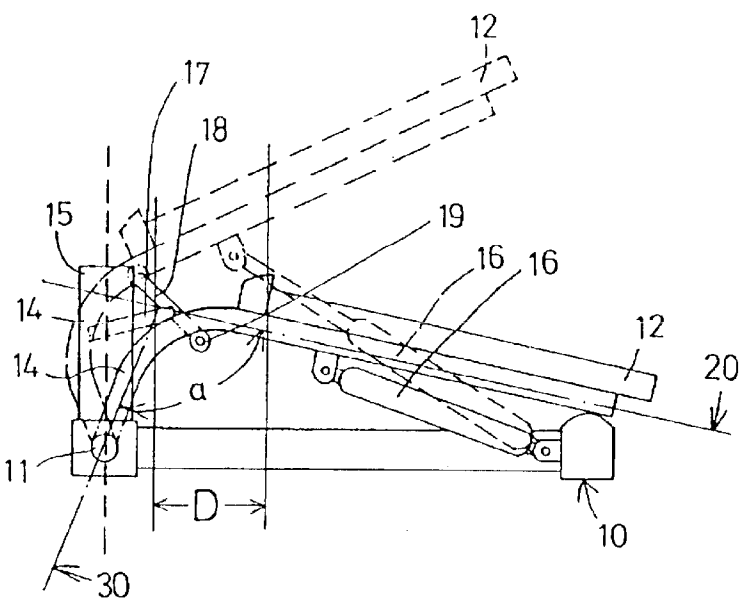
FIG. 3 is a side view similar to FIG. 2, illustrating the operation of the stepping exerciser.
Figure 5:
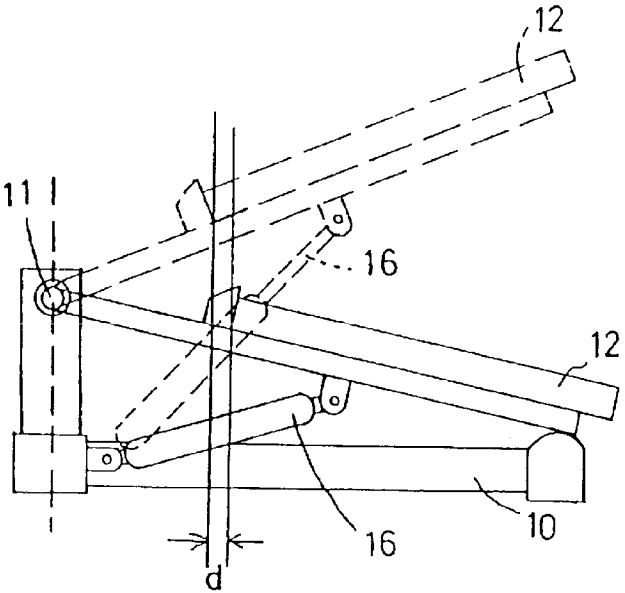
FIG. 5 PRIOR ART
FIG. 5 is a side view illustrating one of the typical stepping exercisers.

In operation, as shown in FIG. 3, when the foot pedals 12 are moved or rotated up and down relative to the base 10 about the pivot shaft 11, the foot pedals 12 may include a lateral movement "D" greater than the lateral movement "d" of that of the typical stepping exercisers (FIG. 5). When stepping or exercising on the stepping exerciser as shown in FIGS. 1–3, the feet of the users may move relatively upward and forward when the foot pedal 12 is moved or rotated upward, and may move relatively downward and rearward when the foot pedal 12 is moved or rotated downward.

It is to be noted that the offset of the plane or the longitudinal axis 20 of the foot pedal 12 from the pivot shaft 11 may increase the lateral movement of the foot pedals 12 relative to the base 10, when the foot pedals 12 move up and down relative to the base 10. Or, the bent segments 14 of the foot pedals 12 may be rotated or moved forward and rearward relative to the pivot shaft 11, best shown in FIGS. 2–3, for increasing the lateral movement of the foot pedals 12 relative to the base 10, when the foot pedals 12 move up and down relative to the base 10.

Figure 4:
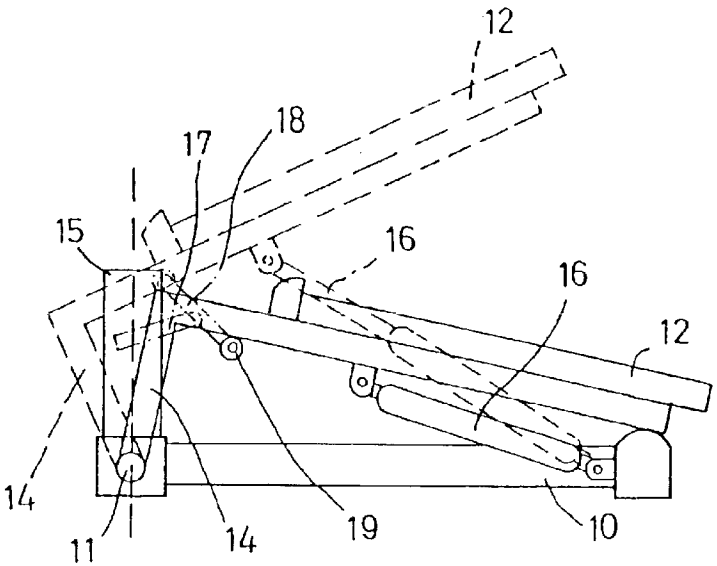
FIG. 4 is a side view similar to FIGS. 2 and 3, illustrating the other embodiment of the stepping exerciser.

Referring next to FIG. 4, the included angle "a" between the longitudinal axes 20, 30 of the foot pedal 12 and the bent segment 14 may be arranged or formed smaller or greater. The requirement or the limitation of the included angle "a" is provided or arranged for allowing the foot pedals 12 to be moved up and down in order to conduct the stepping exercises. For example, the included angle "a" between the longitudinal axes 20, 30 of the foot pedal 12 and the bent segment 14 may be arranged or formed less than 30 degrees or greater than 150 degrees, provided that the foot pedals 12 may be moved up and down relative to the base 10 in order to conduct the stepping exercises by the users.

The base 10 may further include a post 15 extended upward therefrom, such as extended upward from the front and middle portion thereof, and preferably located between the foot pedals 12. A rod 17 may further be provided and rotatably secured to the base 10, or secured to the post 15. A lever 18 is secured to the rod 17, and includes two ends located below and engaged with the bottom of the foot pedals 12, for supporting the foot pedals 12, and for coupling or connecting the foot pedals 12 together. Two cushions or pads 19 are further provided and attached onto the ends of the lever 18, for resiliently or safely engaging with the bottom of the foot pedals 12.

In operation, when one of the foot pedals 12 is depressed downward by the users, the other foot pedal 12 will be forced and actuated to move upward by the lever 18. On the contrary, when the other foot pedal 12 is depressed downward by the users, the one foot pedal 12 will be forced and actuated to move upward by the lever 18.

Accordingly, the stepping exerciser in accordance with the present invention includes an increased lateral movement.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A stepping exerciser comprising:

a base including a first end having a pivot shaft provided therein, a pair of foot pedals including a first end having a bent segment provided thereon and bent and inclined relative to said foot pedals respectively, said bent segments each including a first end located close to said foot pedals respectively, and each including a second end pivotally secured to said base with said pivot shaft, for allowing said foot pedals to be moved up and down relative to said base, a rod rotatably secured to said base, a lever secured to said rod at said lever's midpoint and including two ends, each engaged with one of said foot pedals respectively, for supporting said foot pedals, said bent segments of said foot pedals each including a longitudinal axis, said longitudinal axes of said foot pedals and said bent segments respectively including an included angle formed therebetween, and said bent segments of said foot pedals being rotatable and movable forward and rearward of said pivot shaft, for increasing a lateral movement of said foot pedals when said foot pedals are moved up and down relative to said base.

2. The stepping exerciser according to claim 1 further comprising means for applying a resistive force against said foot pedals.

3. The stepping exerciser according to claim 1 further comprising two pads attached to said ends of said lever, to engage with said foot pedals respectively.

4. The stepping exerciser according to claim 1, wherein said ends of said lever are engaged with bottom of said foot pedals respectively.

5. The stepping exerciser according to claim 1, wherein said base includes a post extended therefrom, said rod is rotatably secured to said post of said base.

* * * * *